United States Patent [19]

Olsen

[11] 4,215,909

[45] Aug. 5, 1980

[54] ELECTRICAL TERMINAL CLAMP FOR ESTABLISHING AN ELECTRICALLY CONDUCTING CLAMPING CONNECTION

[76] Inventor: Axel Olsen, Fortunvej 86, DK-2920 Charlottenlund, Denmark

[21] Appl. No.: 922,322

[22] Filed: Jul. 6, 1978

[30] Foreign Application Priority Data

Nov. 18, 1977 [DK] Denmark ..... 5136/77

[51] Int. Cl.[2] ..... H01R 9/08

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,129,995 | 4/1964 | Brown | 339/97 P |
| 3,585,572 | 6/1971 | Krone et al. | 339/97 R |
| 3,675,182 | 7/1972 | Gregory | 339/98 |

FOREIGN PATENT DOCUMENTS

| | | | |
|---|---|---|---|
| 2454212 | 5/1975 | Fed. Rep. of Germany | 339/97 R |

*Primary Examiner*—Joseph H. McGlynn

*Attorney, Agent, or Firm*—Watson, Cole, Grindle & Watson

[57] ABSTRACT

A terminal clamp for insulated electrical wires comprising a housing having a cylindrical bore with an electrically conducting wall. The housing has holes for introducing ends of wires into the bore circumferentially of its wall. A clamping member is rotatably mounted in the bore and has one or more rounded edges for gripping the wire, sliding it at least 60° circumferentially forward in the bore and pressing the conductor of the wire out through the insulation into contact with the conducting wall of the bore. The apex angle of the rounded edges is less than 135°, and their radius of curvature is less than the diameter of the conductor.

21 Claims, 16 Drawing Figures

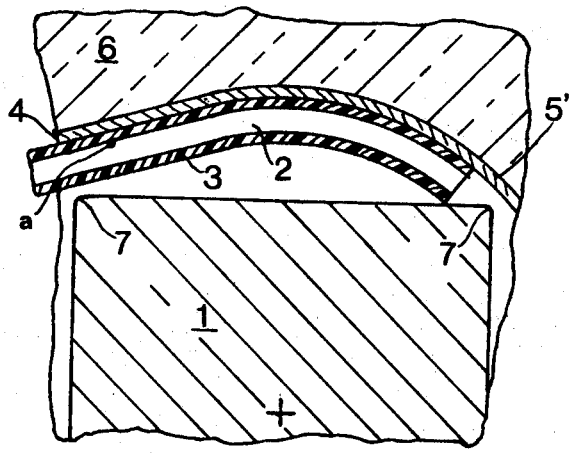
FIG.1
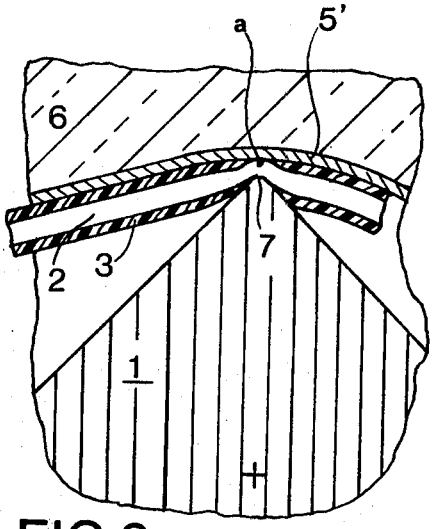
FIG.2
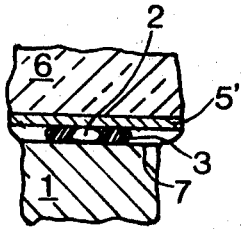
FIG.3
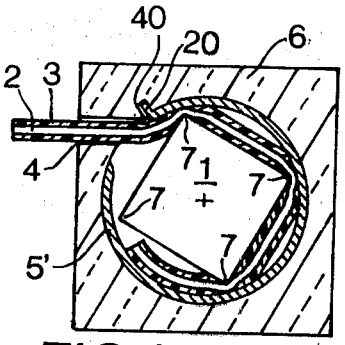
FIG.4
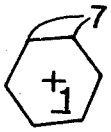
FIG.5
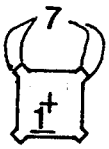
FIG.6
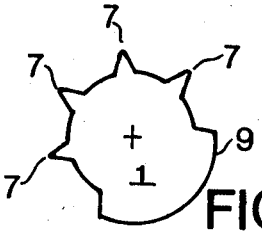
FIG.7
FIG.8
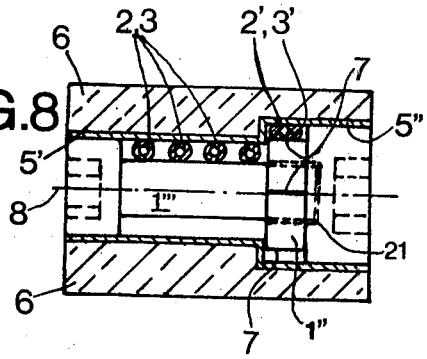

ELECTRICAL TERMINAL CLAMP FOR ESTABLISHING AN ELECTRICALLY CONDUCTING CLAMPING CONNECTION

BACKGROUND OF THE INVENTION

This invention relates to an electrical terminal clamp for establishing an electrically conducting clamping connection between an electrically conductive wall of a housing of the terminal clamp and an insulated electrical wire being introduced into the housing along its electrically conductive wall, a clamping member being rotatably mounted in the housing for turning movement in the longitudinal direction of the wire in such a manner that during such turning movement relative to the wall, upon baring and contactual engagement of the wire, a clamping slot is formed which is narrower than the diameter of the conductor of the wire.

A terminal clamp of this kind is known, comprising a clamping member which is rotatably mounted relative to a cylindrical wall and is constructed with a cutting edge or a saw-toothed cam, by means of which the insulation is ruptured before the clamping is completed and contact is established via the cutting edge or saw-toothed cam or via a zone of the clamping member adjacent the cutting edge or the saw-toothed cam. Where a saw-toothed cam is used, the peeling-off of the insulation layer will be accompanied by an accumulation of insulating material between the saw-teeth, and this accumulated insulating material will exert a pressure counter-acting the contact pressure which must therefore be chosen sufficiently high for overcoming this counter-pressure. Moreover, there is a risk that a cutting edge or a saw-toothed cam, in the process of removing the insulation or afterwards, may damage the naked conductor of the wire and form notches therein which may initiate rupture and thereby destruction of the electrical connection. Terminal clamps in which the insulation is peeled off the wire are not suitable for the re-establishment of electrical connection with a previously used wire end, first because the establishment of contact takes place at the same point of the wire end as previously, whereby the contact pressure generally becomes lower and, second, because the terminal clamp must each time be emptied of previously peeled-off insulating material, which complicates the operation, not least if the terminal clamp is fixedly mounted or is integral with other terminal clamps.

A terminal clamp is also known in which the clamping member is constructed with a rounded pressing portion which upon turning of the clamping member locally flattens the wire over a relatively long length so that the conductor of the wire is pressed against a conducting surface to establish contact with same, the baring of the wire taking place by causing the conductor of the wire to penetrate the insulation over the noted relatively long length of the wire. Since the rounded pressing member engages the conductor over a relatively long length thereof, its dimension in the direction of the conductor must be greater than the diameter of the latter, and the same applies to its radius of curvature. As a consequence, a relatively high force is required for the flattening of the wire and for causing the conductor to penetrate the insulation and to establish the metallic contact. This again means that a relatively great torque will be required for turning the clamping member so that it will be necessary to use a lever for producing the torque required for the establishment of contact with even a single wire. Also in this case the re-establishment of the connection will result in a poorer contact unless the previously used wire end is cut off. Owing to the high pressure required for the operation of establishing contact, each such operation will give rise to considerable wear unless the movable parts are lubricated each time.

SUMMARY OF THE INVENTION

The terminal clamp according to the invention is characterized by the combination of the following features:

the clamping member is constructed with at least one rounded edge, the radius of curvature of which is less than the diameter of the conductor, the surface portions adjacent each such rounded edge forming an angle of not more than 135°, each edge is so arranged that upon turning of the clamping member through at least 60°, the wire is clamped and displaced along the wall and is thereby bared and contactually engaged by rupturing of the insulation by the wall and the conductor in the clamping slot at each edge during the displacement of the wire, the wall is cylindrical and so arranged that the clamping slot is kept constant or is slightly narrowed during the displacement of the wire along the cylindrical wall under the influence of the edge, the clamping member and the housing consist of practically non-elastic material, the wall is non-compressible, at least perpendicularly to its surface facing the edge.

In the inventive terminal clamp the drawbacks of the above-mentioned known terminal clamps are eliminated, and a terminal clamp is provided which is suitable for the re-establishment of electrical connection with a wire that has previously been connected with the clamp, because no removal of insulating material takes place, and the conductor is not deformed over a considerable length, but only in the zone of each edge of the clamping member over a length of the conductor which is smaller than the diameter of the conductor. Moreover, a relatively low contact pressure will suffice, partly owing to the small area of each edge, and partly owing to the fact that the conductor is displaced along the cylindrical wall, whereby the conductor penetrates more quickly through the insulation and is bent into curved shape, which additionally promotes the penetration through the insulation and also improves the retention of the wire in the terminal clamp.

The cylindrical wall may advantageously constitute the electrical connection with the conductors of other wires introduced along the same wall. Thereby the same turning movement may be utilized for establishing electrical connection between the wall and a plurality of insulated conductors which are either introduced into the terminal clamp in parallel relationship and are simultaneously engaged therein by a rounded edge, or are introduced in staggered relationship and are engaged by different rounded edges. The size of the clamping slot may advantageously be adapted to the thickness and hardness of the insulation of the wire, its minimum value being of the order of $\frac{1}{3}$ of the diameter of the conductor, meaning that the thicker or the harder the insulation is, the more should the size of the clamping slot approach $\frac{1}{3}$ of the diameter of the conductor. By making the surface of the wall facing the clamping member rough, at least in the direction of turning of the clamping member, the establishment of the contact is further facilitated and accelerated because the roughness of the surface contributes towards tearing away the insulation of the wire in the terminal clamp.

Advantageously, the mutual spacing of at least one pair of successive edges may be less than the diameter of the conductor, one of the surfaces adjacent the rounded portions of the pair of successive edges being common to the two edges of the pair. Thereby the advantage is obtained that the common surface between the two edges, the extension of which surface is less than the diameter of the conductor, acts as an additional pressing surface for the establishment of contact. This arrangement of pairs of rounded edges is particularly advantageous where the clamping member is made from glass fiber-reinforced plastic because the strength of the clamping member is increased by the pair-wise arrangement of the rounded edges. Advantageously, the mutual space between at least every second pair of successive edges may be sufficiently large for accomodating a length of practically non-deformed wire. Thereby the initial introduction of the wire along the conducting wall, before it is engaged by the rounded edge first to arrive upon turning of the clamping member, is facilitated, and if the clamping member is constructed with a plurality of circumferentially spaced rounded edges, the non-deformed lengths of wire present in the spaces between the rounded edges will act as dog members in the further forwarding of the wire into the terminal clamp and as retaining members against extraction of the wire from the terminal clamp. Besides the cylindrical wall, the clamping member may also be electrically conducting, at least in the zones of the rounded edges. Thereby the advantage is obtained that where the terminal clamp is, e.g., used for mutually connecting a plurality of wires introduced into the terminal clamp, the conductors of these wires are interconnected both via the cylindrical wall and via at least one conducting edge of the clamping member. Moreover, where the clamping member is made from plastic, an electrically conducting metal plating will serve as an additional reinforcement of the rounded edges.

In an embodiment of the invention, the cylindrical wall is subdivided in the longitudinal direction of the rounded edges into a plurality of wall sections which are anchored against displacement and are mutually insulated, the clamping member being made from non-conducting material, at least at the rounded edges, in the zones of the spaces between the wall sections. Thereby it becomes possible, in the same terminal clamp and by the same turning movement of the clamping member, to establish a plurality of different electrical connections, each wall section being connected with the wires introduced along that wall section. If the clamping member is made from conductive material or has electrically-conducting rounded edges, the parts of the clamping member or the rounded edges located in the zones of the different wall section must be mutually electrically insulated. The wall or each wall section may be connected to a connecting terminal outside the housing. Thereby a terminal clamp is provided, which, besides having the previously mentioned advantages, can also be used as a male or female plug of socket, single or multi-plug, terminal row, connector, etc., in which a plurality of insulated wires can be simultaneously connected by a single turning movement.

The rounded edges of the clamping member may either extend parallel to the axis of rotation of the clamping member or along a helical line around the axis. Hereby the clamping member may be produced in a simple manner, e.g., by extrusion, followed by twisting as required. In the helical embodiment the contact area between the conductor and the conducting wall can be slightly increased inversely proportional to the pitch of the helical line.

The rounded edges may advantageously be rotably mounted concentrically or eccentrically with respect to the cylindrical wall. Where the wire is a single-core telephone wire, the radius of curvature of the rounded edges may preferably be of the order of 0.2 mm.

The clamping member may advantageously comprise a profiled rod extending between two circular end plates which are rotatably mounted in the housing, the rod being integral with the end plates or being received in concentrically or eccentrically located recesses of the end plates which recesses have a shape complementary to the cross-sectional shape of the rod. Thereby the clamping member is held at a predetermined distance from the cylindrical conducting wall in a simple manner so that the movement of the rounded edges is accurately controlled by the end plates.

The wall or each wall section may advantageously be constituted by a longitudinally slitted cylindrical tube element consisting of electrically conducting resilient metal, the free diameter of the tube element being slightly greater than the diameter of an inner cylindrical wall of the housing serving to support the tube element in the housing, at least one of the longitudinal slit edges of the tube element being bent outwards to be received in a corresponding longitudinal notch in the inner cylindrical wall of the housing. Thereby a construction is obtained in which the conducting wall is prevented from rotating about its axis and is closely applied to the inner cylindrical surface of the housing under a certain pressure which is determined by the bias which is produced when the tube element, in order to be introduced into the housing, is reduced to a diameter equal to that of the inner cylindrical surface of the housing.

Instead of using a tube element, the surface of the wall facing the clamping member may be made electrically conducting by metal plating. In either case the wall will become sufficiently incompressible to resist the local pressure forces which are transmitted from the rounded edges via the wire.

Preferably the clamping member has at least two edges located in diametrically opposite positions. Thereby at least some of the forces in the terminal clamp are balanced so as to obtain a better distribution of the wear in the terminal clamp caused by repeated use of same.

BRIEF DESCRIPTION OF THE DRAWING

FIG. 1 is a cross section through a terminal clamp and an insulated electrical wire introduced into same, the clamping member of the terminal clamp being located in a position permitting the introduction of the wire.

FIG. 2 shows the same parts as FIG. 1 after the clamping member has been turned through a certain angle in the longitudinal direction of the wire and has thereby clamped the wire and displaced it along the wall, thereby baring it and contactually engaging it with the wall.

FIG. 3 is a section through the edge of the clamping member perpendicularly to the cylindrical wall of the terminal clamp and to the wire.

FIG. 4 shows the parts of FIGS. 1 and 2 on a smaller scale, the wire having been moved into the terminal clamp over a length corresponding to about 225° turning of the clamping member.

FIG. 5 shows a modified form of the clamping member.

FIG. 6 shows an embodiment of the clamping member preferably made from glass fibre-reinforced plastic.

FIG. 7 shows a form of the clamping member which is particularly suitable for the introduction, baring and contactual engagement of multi-core conductors.

FIG. 8 is a longitudinal section through a form of a terminal clamp with rotatably mounted clamping members, one of which is shown in its position for introducing a wire, while the other is shown as moved to its contact establishing position.

DESCRIPTION OF THE PREFERRED EMBODIMENTS

Figure 9:
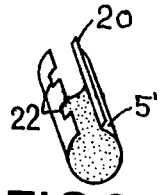
FIG. 9 shows an electrically conducting cylindrical wall for insertion into the housing of the terminal clamp in contact with an inner cylindrical surface.

FIG. 1 shows a cross section of a terminal clamp, in which a clamping member 1 is rotatably mounted for turning in the longitudinal direction of a wire 2,3 introduced into the terminal clamp, in such a manner that upon turning of the clamping member 1 relative to a wall 5' a clamping slot is formed which is less than the diameter of the conductor 2 of the wire, whereby the wire is bared and contactually engaged to establish clamping electrical connection between the conducting wall 5' of the housing 6 of the terminal clamp and the insulated electrical wire 2,3. The clamping member 1 of FIG. 1 is constructed with four rounded edges 7, the radius of curvature of which is less than the diameter of the conductor 2, the surfaces adjacent each rounding forming an angle of 90°. The wall 5' is cylindrical and, in the embodiment shown, is arranged coaxially with the axis of the clamping member 1 so that the clamping slot between the wall 5' and each edge 7 is kept constant during the displacement of the wire 2,3 along the cylindrical wall 5' under the influence of the edges. The clamping member 1 and the housing are made from practically non-elastic material and the wall 5' is incompressible at least perpendicularly to its surface facing the edges 7. During the introduction of the wire into the terminal clamp through an entrance opening 4, one of the edges 7 is in such a position relative to the opening that the wire can be introduced along the conducting wall 5' to the position shown in FIG. 1, the wire being bent along the cylindrical wall during its introduction, whereafter the clamping member is turned in the clockwise direction from the position shown in FIG. 1 to that shown in FIG. 2, whereby the clamping slot becomes smaller than the diameter of the conductor 2, while at the same time the point a of the conductor 2 marked in FIG. 1 is displaced along the wall 5' by the edge 7 and is contactually engaged with the wall in the position shown in FIG. 2, the edge 7 pressing the conductor 2 out through its insulating layer 3. When the clamping member 1 has been turned about 60°, the conductor, which is locally bared at its point of contact with the wall 5', has been displaced through such a distance along the wall 5' that a high security of contact is obtained even if this is approximately limited to a point, at any rate in comparison with the previously mentioned known clamping member.

FIG. 3 shows the condition of the wire in the clamping slot between the edge 7 and the wall 5' in FIG. 2. From FIG. 2 it is apparent that in the zone of the edge 7 the conductor 2 extends along a curve with two inflections, the conductor 2 being first bent towards the wall 5' and then away from the wall and is finally bent back to parallelism with the wall by the cooperation of the edge 7 with the wall 5' and the insulating layer 3 of the conductor 2. Practically the same effect occurs in the zones of the two other edges 7 as shown in FIG. 4. By the local penetration and displacement of the part of the insulating layer 3 of the conductor 2 facing the clamping member 1 under the influence of the edge 7 a local, plastic, notch-free deformation of the thereby bared conductor takes place, while the conductor is at the same time caused by the pressure in the clamping slot to slide along the wall 5', while overcoming the friction against the latter. At the same time a direct contact will also take place between the conductor 2 and the edge 7, but seeing that in the continued turning movement following the situation illustrated in FIG. 2, any metallic conducting contact established between the conductor 2 and the edge 7, if the latter is or has been made conducting, will probably be less reliable than the metallic contact occurring between the conductor 2 and the wall 5'. The form of the wall 5' shown in FIG. 4 is constituted by a longitudinally slitted tube element of electrically conducting spring metal, the free diameter of the tube element being somewhat greater than the diameter of the inner cylindrical surface of the housing 6 which supports the tube element when this has been inserted into the housing 6. Moreover, it will be seen that one of the longitudinal slit edges 20 is bent outwards and is received in a corresponding longitudinal groove 40 in the cylindrical inner surface of the housing. The contact pressure between the wall 5' and the conductor 2 does not depend on the elastic deformation of the insulation of the wire, because the edge 7 engages the conductor 2 directly and the conductor 2 contacts the wall 5' directly. This independence of the elastic deformation of the insulation is advantageous because many insulating material loose their elasticity in the course of time. In the position shown in FIG. 4, where the establishment of contact has been completed, the smallest distance between the edge 7 of the clamping member 1 and the conducting wall 5' is smaller than the diameter of the naked conductor 2 and greater than its radius, whereby, besides an efficient electrical connection between the conductor 2 and the conducting wall 5', a strong clamping effect is obtained between the clamping member 1, the conductor 2, the insulating layer 3 and the conducting wall 5', thereby producing a high frictional force against extraction of the conductor 2 from the terminal clamp.

The clamping member can be constructed with many different cross sections, of which a square section is the simplest one from the point of view of production, but also other cross sectional shapes such as 3, 5–8 edged cross sections can be used provided that these have rounded edges, the radius of curvature of which is less than the diameter of the conductor 2, and the surfaces adjacent each rounded edge may be plane, concave or convex depending on the intended use of the terminal clamp. The same applies to the size of the clamping slot, and whether it is to be constant or decreasing. The selection depends, e.g., on the material of the conductor 2, the material of the insulating layer 3, particularly whether these are hard, plastically or elastically deformable, and on the relative and absolute thicknesses of the conductor 2 and the insulating layer 3. Moreover, it is of significance whether the conductor 2 is a single- or multicore conductor. The cross sectional shape of the clamping member 1 to be selected also depends on the material from which the clamping member is made. FIG. 5 shows a hexagonal cross section of the clamping member 1, where the rounded edges 7 are uniformly distributed along the perimeter. FIG. 6 shows a octagonal shape of the clamping member 1, which is particularly suitable for clamping members made from glass fibre-reinforced plastic. In this embodiment, the edges 7 are arranged pair-wise in the form of four pairs, where the space between the edges of each pair is less than the diameter of the conductor 2, and the surfaces adjacent the rounded edges of each pair are common to the two edges 7. Thereby the lifetime of the clamping member 1 is increased, and moreover, the common surface between the two edges 7 serves an extra function, the pressing forces of the edges 7 being distributed over this surface, while the edges 7 maintain their normal function, viz. to catch, clamp and move the conductor as well as to bare and contactually engage the same. FIG. 7 shows an embodiment which has been found suitable for multi-core conductors and in which the angle between the two surfaces adjacent the rounded edges is less than 90°. In this case part of the cross section of the clamping member constitutes a supporting surface 9 which is not intended for engaging the wire, but for abutting the cylindrical conducting wall 5'.

FIG. 8 shows an example of a terminal clamp having two rotatably mounted clamping members 1'' and 1''' respectively, which are inserted from opposite ends of the housing 6 and co-operate with a cylindrical wall 5'' of large diameter, and a cylindrical wall 5' of smaller diameter, respectively. The clamping members can be turned independently of one another about a common axis 8, one end of one clamping member 1''' being rotatably mounted in a bore 21 of the other clamping member 1''. The clamping member 1'' can thereby penetrate and displace the insulating layer 3' on a conductor 2' to establish metallic contact with the wall 5'' independently of the position of the other clamping member 1'''. In the situation shown the conductor 2' is in conducting contact with the wall 5'', while the wires 2,3 have just been introduced prior to establishment of their electrical contact with the wall 5' which is connected with the wall 5'' through a connecting portion. It has surprisingly been found that if the surface of the conducting wall 5' or 5'' facing the cavity is not smooth in the direction of movement of the edge 7 in the cavity, a very satisfactory conducting contact will be established between the conductors 2 or 2' and their respective conducting wall portions 5' and 5'', respectively, so that the clamping member 1 itself need not consist of conducting material, but can, e.g., be made from a hard plastic, glass or the like, constructed with an edge 7, the radius of curvature of which in the zone of contact with the insulated conductor 2 is between 0 and 1 mm in one plane and is greater than the free cross sectional radius of the naked conductor in a plane perpendicular to the first plane.

The housing or the supporting material 6 should consist of a non-inflammable, non-moisture-absorbing material having a low coefficient of thermal expansion and a low coefficient of elasticity. Examples of such materials are thermo-hardening plastics, such as polyphenyleneoxide, poly-methyl-metha-cryolate, phenol resins, carbamide resins, melamine resins, with or without a filling of glass fibres, and glass.

As mentioned, the conducting wall 5' of the housing 6 may have a surface which is not smooth in the direction of movement of the edge 7. For example, the surface may be frosted or produced by drawing with the drawing direction perpendicular to the direction of movement of the edges. If the wall 5 is applied in the form of a plating and may therefore have a relatively smooth surface, the wall may be ground in such a manner as to produce grinding traces extending in the axial direction of the cylindrical wall 5'. The material of the wall may, e.g., be a silver alloy, such as German silver, a copper alloy, an aluminum alloy, a precious metal alloy, brass, spring bronze or stainless steel, and to ensure a long lifetime the material should be harder than the material of the conductor 2.

The material of the clamping member 1 should have a coefficient of thermal expansion of such a value that the distance between the surface of the wall 5' and the clamping member does not under the influence of temperature changes or in the course of time change more than permissible to maintain the contact function of the terminal clamp. The material may have a relatively low coefficient of elasticity and a greater hardness than the conductor 2. The clamping member may, e.g., consist of drawn stainless steel, a hard copper alloy, a hard thermoplastic material, glass or glass fibre-reinforced plastic. If the clamping member is made from drawn rod material in cut-off lengths, these can be mounted at the ends of the cylindrical wall 5' as, e.g., shown in FIG. 8, by means of heads which are fixed to the ends of the rod material and may consist of the same material as the housing 6. Among fibre reinforced thermo-hardening plastic polymethylene, polycarbonate, polyamide 11 have been found suitable.

Figure 10:
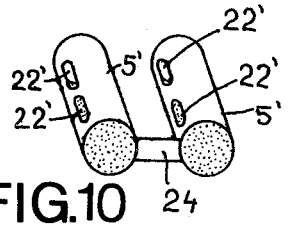
FIG. 10 shows another form of a conducting wall for two inner cylindrical surfaces of a housing of a terminal clamp, the wall portions present at the two cylindrical surfaces being mutually electrically connected.
Figure 16:
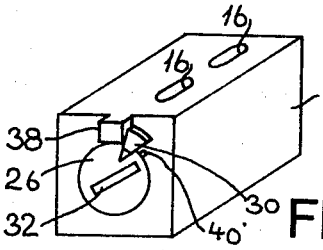
FIG. 16 shows a form of a terminal clamp where the clamping member of FIGS. 12–14 has been mounted in the housing of the terminal clamp.

FIG. 9 shows an example of the conducting wall 5' in the form of a cylindrical tubular, longitudinally slitted insert, where one of the edges of the slit is bent outwards to form a web 20, while the other edge of the slit is constructed with cuts 22, which are located exactly in the areas of the entrance openings 16, FIG. 16, when the conducting wall or the insert 5' is mounted in the cylindrical bore of the terminal clamp. These cuts 22 may be omitted if the width of the slit of the insert 5' is made greater such as in the embodiment of FIG. 4. The embodiment shown in FIG. 10 is a double insert consisting of two conducting walls' in the form of a cylindrical tube elements which are electrically connected with each other via a connecting piece 24, the length of which correspond to the distance between two bores located side by side in the terminal clamp, the two conducting walls 5' being introduced at a press fit. In both embodiments of FIGS. 9 and 10 the tube elements may be roughened on their inner side as indicated by a dotted pattern. In the embodiment of FIG. 10, the connecting piece 24 serves both to establish an electrically conducting connection between the two inserts or conducting walls 5' and to ensure the placing of openings 22' formed in the inserts in the areas of the entrance openings 16, FIG. 16. In each insert one or two clamping members of the type shown in FIG. 8 or 12 may be mounted. If two clamping members are used in each insert they are introduced from opposite ends of the insert.

Figure 12:
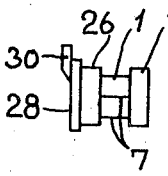
FIG. 12 is a side view of a clamping member provided with mounting plates and an indicator of the turning position.
Figure 13:
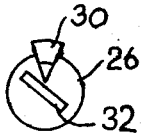
FIG. 13 shows the parts of FIG. 12 as viewed from the left.
Figure 14:
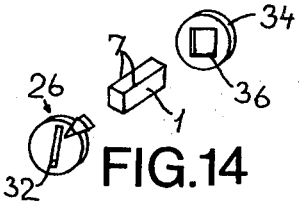
FIG. 14 is an exploded view of clamping members and end plates.

The clamping member 1 may, as illustrated in FIGS. 12–14, consist of a length of cut rod material provided with edges 7 and being received in two end pieces 26 and 34 respectively, one end piece being constructed at its outer end with a stop collar 28 serving to prevent the clamping member from being pushed too far into its insert, an indicator nose 30 serving both to show the position of the clamping member on the exterior of the housing 6 and to stop the turning movement of the clamping member in both its extreme positions, when the nose 30 strikes a projection 38 of the housing, and a screw driver notch 32 for engagement with the blade of a screw driver for turning the clamping member. The notch 32 may also serve as position indicator of the clamping member if the nose 30 and the projection 38 are omitted, such as is, e.g., the case in the embodiment of FIG. 11. FIG. 13 is an end view of the clamping member, and FIG. 14 is an exploded view of the clamping member which is assembled by introducing the ends of the clamping member 1 in respective recesses 36 of the end pieces 26 and 34, the clamping member 1 being held by press fit or by means of an adhesive. The end pieces 26 and 34 can also be applied to the clamping member by moulding in a die.

Figure 15:
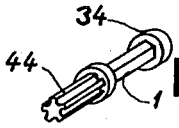
FIG. 15 shows another form of a clamping member with mounting plates, one of which is constructed with a finger operated knob.

FIG. 15 shows an embodiment in which the clamping member 1 is mounted between end pieces 34 and 44, of which the end piece 44 is constructed with a finger operated knob. Such a knob will frequently suffice, at any rate, if only two conductors are introduced into the terminal clamp for being connected with each other via the conducting wall 5'.

FIG. 16 shows an embodiment where two clamping members of the type shown in FIGS. 12 and 13 are inserted from opposite ends of the housing 6 and where the cylindrical wall 5', which is common to the two clamping members, is constituted by an insert as illustrated in FIGS. 4, 8 or 9. The establishment of contact between each clamping member 1, conductor 2 and insert 5' is effected by introducing the end of the wire through one of the entrance openings 16 followed by turning of the clamping member by means of screw driver, whereby the wires introduced through the openings 16 are simultaneously pulled along the cylindrical wall 5' and have their insulation penetrated to establish conducting contact with the wall 5' and, if desired, also with the edges 7 of the clamping member 1, if these are conducting. When the indicator nose 30 strikes the projection 38 on the opposite side, the establishment of contact has been completed. In this embodiment, wires connected with one clamping member can be replaced without disconnecting the wires held by the other clamping member. The housing 6 can be provided with one or two rows of cylindrical bores, each containing an insert 5' and one or two clamping members which are rotatable independently of one another. Instead of being provided with the notch 32 the end piece 28 may be constructed as shown in FIG. 15 or may be provided with an operating wing for manual operation and for simultaneously serving as a position indicator and for abutting the projection 38. The notch 32 may also be replaced by a polygonal or stellar recess for engagement by a correspondingly shaped key.

In one practical example of a terminal clamp according to the invention, the bores of the housing have a diameter of 6.9 mm and a length of 22 mm. There may be provided four entrance openings 16 of diameter 1.5 mm for telephone wires in the zone of each clamping member 1, the respective total length of which, exclusive of the indicator nose 30 is 11 mm which have a square cross-section with a side length of 4 mm with a span of 5.5 mm from one rounded edge 7 to a diametrically opposite edge 7. The diameter of the end pieces 26, 34 is 6.4 mm and the thickness of the conducting wall 5' is 0.2 mm.

Figure 11:
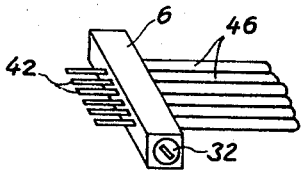
FIG. 11 shows a form of a terminal clamp for the connection of a flat 6-conductor cable with six contact pins in one operation.

FIG. 11 shows an embodiment, in which the terminal clamp is used for connecting a ribbon cable 46 with a number of connecting terminals 42 corresponding to the number of conductors of the ribbon cable. Each connecting terminal is integral with a separate wall section in the interior of the housing 6, the wall 5' being subdivided in the longitudinal direction of the edges 7 to provide said separate wall sections which are anchored against displacement in the bore of the housing 6 and are mutually insulated. In this case the clamping member is made from non-conducting material at least at the rounded edges 7 in the zones of the spaces between the wall sections.

As mentioned, the size of the clamping slot is adapted to the thickness and the hardness of the insulation 3 of the wire 2,3, and the minimum value of the clamping slot is of the order of $\frac{1}{3}$ of the diameter of the conductor 2. Instead of using the insert of FIG. 9, the bore of the housing 6 may be metal plated so that the surface of the bore serves as the conducting wall 5'. Likewise, the clamping member 1 may be metal plated, and for both said wall and the clamping member the metal plating may be applied partially so as to provide individual metal plated surfaces insulated from one another. In the embodiments of the clamping member where this has two edges 7 located diametrically opposite one another a balancing of the contact pressure forces during the pulling-in of the wire into the terminal clamp is obtained whereby the wear at the supporting areas of the clamping member is reduced, which is of particular importance, because the terminal clamp according to the invention is intended for repeated use. As a consequence of the small extension of the individual zones of contact of each wire produced by the edges 7 of the clamping member, a wire withdrawn from the terminal clamp can be re-introduced into the terminal clamp with little probability that the zones of contact will co-incide with the previous zones of contact so that the latest establishment of contact becomes just as efficient as the first one, and it is not necessary to cut off the end of the wire before the next establishment of contact, such as in the case with most other similar terminal clamps for insulated electrical wires.

The cylindrical conducting wall 5′ or 5″ has a surface which constitutes a geometrical cylindrical surface with its generatrix parallel to the edge 7 or to the axis of the clamping member 1, but not necessarily having a circular directrix. The directrix of the cylindrical surface may e.g. be an ellipse or a triangle with rounded edges. Moreover, the edges 7 which extend along the cylindrical wall 5′ may be interrupted by partitions arranged perpendicularly to the axis of the clamping member 1 and extending fully or partly to the cylindrical wall 5′, said partitions serving as lateral guides for the wires introduced into the terminal clamp, particularly if the wires have multi-core conductors, to prevent excessive flattening of the conductors when they are pressed against the cylindric wall, and also to increase the force of engagement pulling the wires into the terminal clamp.

I claim:

1. An electrical terminal clamp which comprises a housing having a cylindrical cavity with an electrically conductive wall and including at least one opening for allowing at least one insulating conductor to be inserted therethrough and into said cavity, a clamping member mounted for rotation within said cavity about a fixed axis, said clamping member having at least one non-cutting pinching edge oriented so as to be generally transverse to a center line through each of said openings in said housing, the surface portions of the clamping member adjacent each rounded edge forming an angle of not more than 135° with each other, said clamping member being mounted so as to be movable from a first position at which an insulated conductor can be introduced through said at least one opening in said housing and into said cavity, to a second position wherein a slot narrower than the diameter of the conductor is formed between the pinching edge and the wall of said cavity and the insulated conductor extending through said at least one opening into said cavity will be so clamped between said pinching edge of said clamping member and the wall of said cavity that the conductor will be taken along in the further movement of the pinching edge along the wall of the cavity, and the metallic center portion of the conductor will be pressed out through the conductor insulation and become in electrical contact with the cavity wall, said non-cutting pinching edge being rounded and having a radius of curvature less than 1 mm, the total turning angle of said contact member between the first position and said second position being at least 60°.

2. An electrical terminal clamp as in claim 1, wherein the wall forming said cylindrical cavity includes an electrically conductive portion capable of connecting together all of the metallic center portions of other electrical conductors introduced along the same wall.

3. An electrical terminal clamp as in claim 1 wherein the size of the clamping slot is adapted to the thickness and hardness of the insulation of the electrical conductor, the minimum size being of the order of $\frac{1}{3}$ of the diameter of the conductor.

4. An electrical terminal clamp as in claim 1, wherein the surface of the wall forming said cylindrical cavity facing the clamping member is rough, at least in the direction of turning of the clamping member.

5. An electrical terminal clamp as in claim 1, wherein the mutual spacing of at least one pair of successive edges is less than the diameter of the conductor and that one of the surfaces adjacent the rounded portions of said pair of successive edges is common to the two edges of the pair.

6. An electrical terminal clamp as in claim 1, wherein said clamping member has several pairs of said rounded edges and the mutual space between at least every second pair of successive edges and the cylindrical wall is sufficiently large for accommodating a length of practically non-deformed electrical conductor.

7. An electrical terminal clamp as in claim 1, wherein the clamping member is electrically conducting, at least in the zones of the rounded edges.

8. An electrical terminal clamp as in claim 1, wherein the wall forming said cylindrical cavity is connected to a connecting terminal located outside the housing.

9. An electrical terminal clamp as in claim 1, wherein the rounded edges extend parallel to the axis of rotation of the clamping member.

10. An electrical terminal clamp as in claim 1, wherein the rounded edges extend along a helical line around the axis of rotation of the clamping member.

11. An electrical terminal clamp as in claim 1, wherein the rounded edges are rotatably mounted concentrically with respect to the cylindrical wall.

12. An electrical terminal clamp as in claim 1, wherein the rounded edges are rotatably mounted eccentrically with respect to the cylindrical wall.

13. An electrical terminal clamp as in claim 1, for use with a single core telephone wire, and in which the radius of curvature of the rounded edges is of the order of 0.2 mm.

14. An electrical terminal clamp as in claim 1, wherein the clamping member comprises a profiled rod extending between two circular end plates which are rotatably mounted in the housing.

15. An electrical terminal clamp as in claim 1, wherein the wall forming said cylindrical cavity is constituted by a longitudinally slitted cylindrical tube element consisting of electrically conducting resilient metal, the free diameter of the tube element being slightly greater than the diameter of an inner cylindrical wall of the housing serving to support the tube element in the housing, at least one of the longitudinal slit edges of the tube element being bent outwards to be received in a corresponding longitudinal notch in the inner cylindrical wall of the housing.

16. An electrical terminal clamp as in claim 1, wherein the surface of the wall forming said cylindrical cavity facing the clamping member is made electrically conducting by metal plating.

17. An electrical terminal clamp as in claim 1, wherein the clamping member has at least two edges located in diametrically opposite positions.

18. An electrical terminal clamp as in claim 1, wherein the clamping member carries partitions perpendicular to its axis of rotation having a mutual distance corresponding to the thickness of an insulated electrical conductor to be introduced into the terminal clamp, the edges extending between the partitions, the partitions extending fully or partly to the cylindrical wall.

19. An electrical terminal clamp as in claim 1, wherein the wall forming said cylindrical cavity is subdivided in the longitudinal direction of the edges into a plurality of wall sections which are anchored against displacement and are mutually insulated, the clamping member being made from non-conducting material at least at the rounded edges in the zones of the spaces between the wall sections.

20. An electrical terminal clamp as in claim 19, wherein each wall section is connected to a connecting terminal located outside the housing.

21. An electrical terminal clamp as in claim 19, in which each wall section is constituted by a longitudinally slitted cylindrical tube element consisting of electrically conucting resilient metal, the free diameter of the tube element being slightly greater than the diameter of an inner cylindrical wall of the housing serving to support the tube element in the housing, at least one of the longitudinal slit edges of the tube element being bent outwards to be received in a corresponding longitudinal notch in the inner cylindrical wall of the housing.

* * * * *